US005219081A

United States Patent [19]

Lin

[11] Patent Number: 5,219,081

[45] Date of Patent: Jun. 15, 1993

[54] CLOTHES TREE

[75] Inventor: Cheng-Lin Lin, Kao Hsiung Hsien, Taiwan

[73] Assignee: Good Choice Co., Ltd., Kao Hsiung Hsien, Taiwan

[21] Appl. No.: 882,956

[22] Filed: May 14, 1992

[51] Int. Cl.[5] ..... A47F 7/00

[52] U.S. Cl. ..... 211/205; 211/196

[58] Field of Search ..... 211/205, 33, 62, 196, 211/204, 189

[56] References Cited

U.S. PATENT DOCUMENTS

| | | | |
|---|---|---|---|
| 445,633 | 2/1891 | Becker | 211/205 X |
| 3,661,270 | 5/1972 | Lucci et al. | 211/205 X |
| 4,592,473 | 6/1986 | Efrom | 211/205 |

FOREIGN PATENT DOCUMENTS

| | | | |
|---|---|---|---|
| 2019456 | 11/1971 | Fed. Rep. of Germany | 211/205 |
| 273434 | 7/1927 | United Kingdom | 211/205 |

*Primary Examiner*—Alvin C. Chin-Shue
*Assistant Examiner*—Sarah A. Lechok
*Attorney, Agent, or Firm*—Jacobson, Price, Holman & Stern

[57] ABSTRACT

A clothes tree comprised of a stand, a plurality of tubes, connecting devices, branching hooks and branching rods, wherein said tubes are connected by said connecting devices into an upright pole fastened in a hole on a cone at the top of said stand; said stand has a recessed groove around the cone thereof for collecting rain water from the umbrella hung on said branching rods; said branching hooks are respectively connected to said upright pole and used to hang clothes, of which each comprising a peg rod having one end connected to a socket by a stop element, and an opposite end intersected with either branching rod, said socket being sleeved onto either tube of said upright pole and secured in place by said stop element, said socket comprising a longitudinal hole, into which said stop element is inserted to stop against said upright pole, two side wings longitudinally disposed by said longitudinal hole at two opposite sides with pin holes thereon, into which a lock pin is inserted to connect said stop element and said peg rod to said socket, said branching rod having a plurality of spaced radial flanges and being used to hang umbrellas.

3 Claims, 5 Drawing Sheets

CLOTHES TREE

FIELD OF THE INVENTION

The present invention relates to clothes trees, and more particularly the present invention relates to a clothes tree which has branching hooks, that can be adjusted to the desired levels, and branching rods used to hang umbrellas permitting rain water to be guided into a recessed groove around a cone on a stand.

BACKGROUND OF THE INVENTION

Conventionally, a clothes tree is comprised of an upright pole inserted in a hole on a cone above a base stand, with branching hooks or pegs near the top to hold clothes and hats. This structure of clothes tree is complicated to assemble, because a special tool in required to connect the parts together. Another disadvantage of this structure of clothes tree is that the branching hooks or pegs are fixed and can not be adjusted to the desired angle or level. Another disadvantage of this structure of clothes tree is that the rain water of a wet umbrella may drop here and there around a clothes tree.

SUMMARY OF THE INVENTION

The present invention has been accomplished to eliminate the aforesaid disadvantages. According to one aspect of the present invention, a clothes tree is generally comprised of a stand, an upright pole supported on the stand at the top and consisted of plurality of tubes respectively connected in line by connecting devices, a plurality of first and second branching hooks connected to the upright pole to hang clothes, and a plurality of branching rods respectively connected to the first branching hooks to hang umbrellas, wherein the stand has a recessed groove for collecting rain water from any umbrella hung either branching rod; each first branching hook each comprises a peg rod having one end connected to a socket by a stop element and an opposite end intersected with a branching rod, which socket is sleeved onto the upright pole and secured in place by the stop element.

According to another aspect of the present invention, each connecting device is comprised of a threaded tube having one end formed into a bushing inserted in one tube and an opposite end formed into a screw rod, and a threaded bushing inserted in another tube at one end and screwed onto the screw rod.

According to another aspect of the present invention, each second branching hook comprises a hanger rod used to hang clothes, and a tightening up element used to secure the hanger rod to the upright pole, wherein the hanger rod has one end formed into a socket sleeved onto the upright pole, which socket has an opening aligned with a longitudinal groove on the hanger rod; the tightening up element has two opposite front projections respectively pivotably inserted into two opposite holes on two opposite side walls of the hanger rod with the front end thereof releasably stopped against the upright pole, and two opposite rear projections respectively engaged into two opposite holes on the inside of the longitudinal groove.

According to still another aspect of the present invention, the branching rods are respectively intersected with the first branching hooks, and have each a plurality of spaced radial flanges to hang umbrellas. By hanging any wet umbrella on either branching rod with its tip inserted in the recessed groove of the stand, drain water is guided from the wet umbrella into the recessed groove.

DETAILED DESCRIPTION OF THE PREFERRED EMBODIMENT

Figure 1:
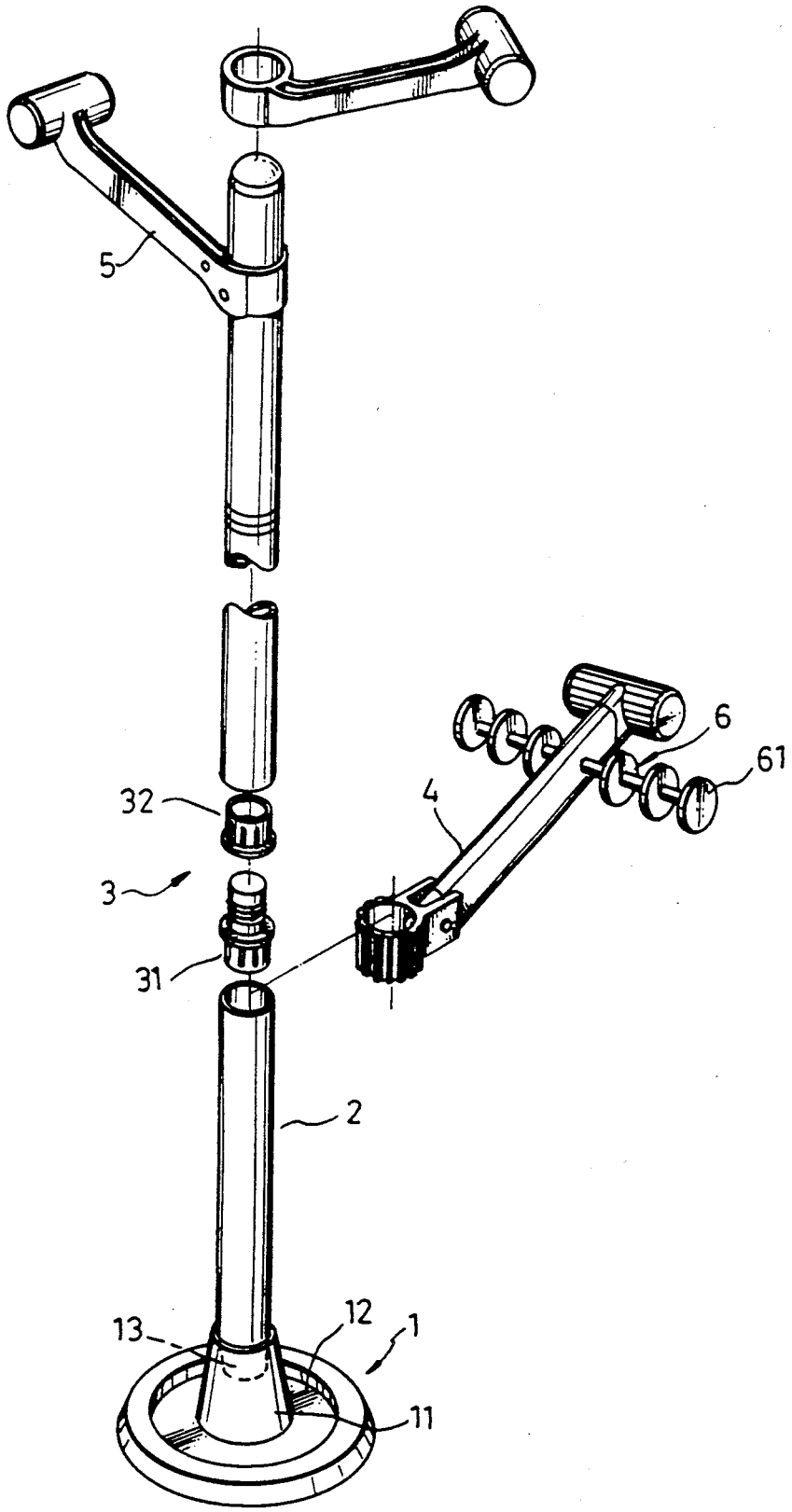
FIG. 1 is an exploded view of the preferred embodiment of the clothes tree of the present invention.

Referring to annexed drawings in detail, therein illustrated is the preferred embodiment of the clothes trees of the present invention, which is generally comprised of a stand 1, a plurality of tubes 2, a plurality of first branching hooks 4, a plurality of second branching hooks 5, a plurality of branching rods 6, and a plurality of connecting device 3.

Referring to FIG. 1, the stand 1 has a cone 11 at the top surrounded by a recessed top edge 12. The cone 11 has a hole 13 on the top edge thereof into which an upright pole, which is consisted of a plurality of tubes 2 longitudinally connected by a plurality of connecting devices 3, is fastened. On the upright pole of the tubes 2, there are connected a plurality of first branching hooks 4 and a plurality of second branching hooks 5. The first branching hooks 4 each has two branching rods 6 connected thereto, which branching rods 6 have each a plurality of spaced radial flanges 61.

Figure 2:
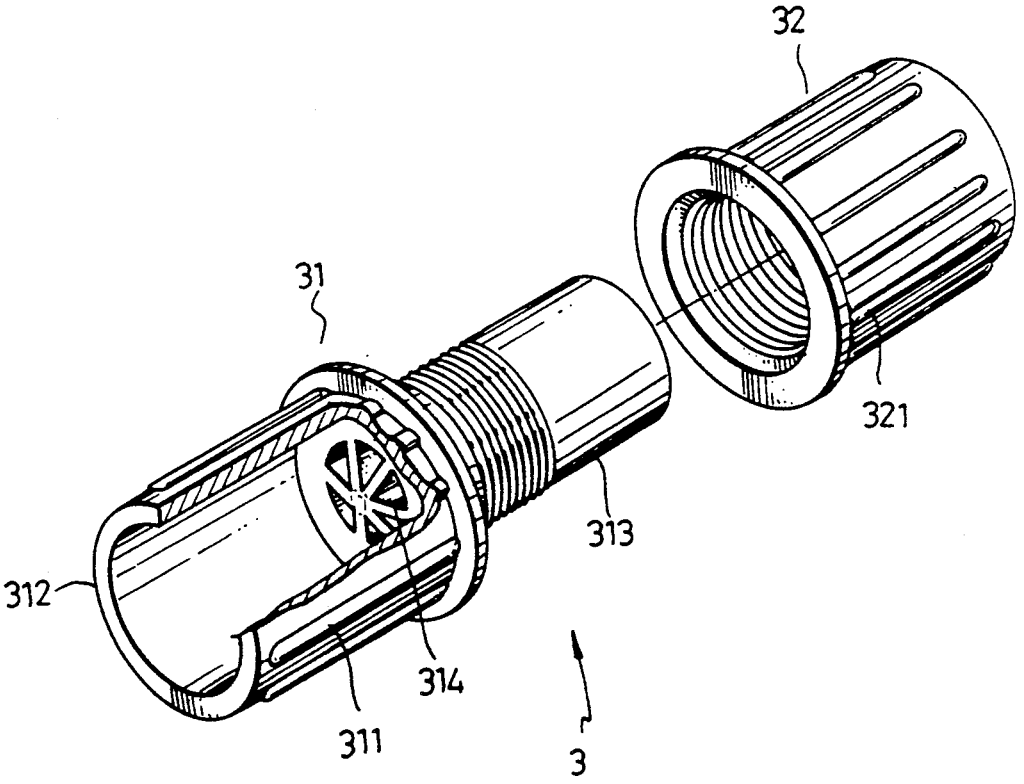
FIG. 2 is a perspective exploded view of the connecting device.

Referring to FIG. 2, the connecting device 3 is comprised of a threaded tube 31 and a threaded bushing 32. The threaded tube 31 has one end formed into a bushing 312, which comprises a plurality of a raised stripes 311 around the outside surface thereof, and an opposite end formed into a screw rod 313, which has an outer diameter slightly smaller than the bushing 312. The threaded tube 31 further comprises a partition wall 314 made in the shape of a star or the like. The position of the partition wall 314 is near the connection of the bushing 312 and the screw rod 313. The partition wall 314 can provide the threaded tube 31 with appropriate elasticity and without decreasing the strength of the threaded tube 31. The threaded bushing 32 is shaped similar to the bushing 312, and has an inner thread on the inside surface thereof and a plurality of raised stripes 321 around the outside surface thereof.

Figure 3:
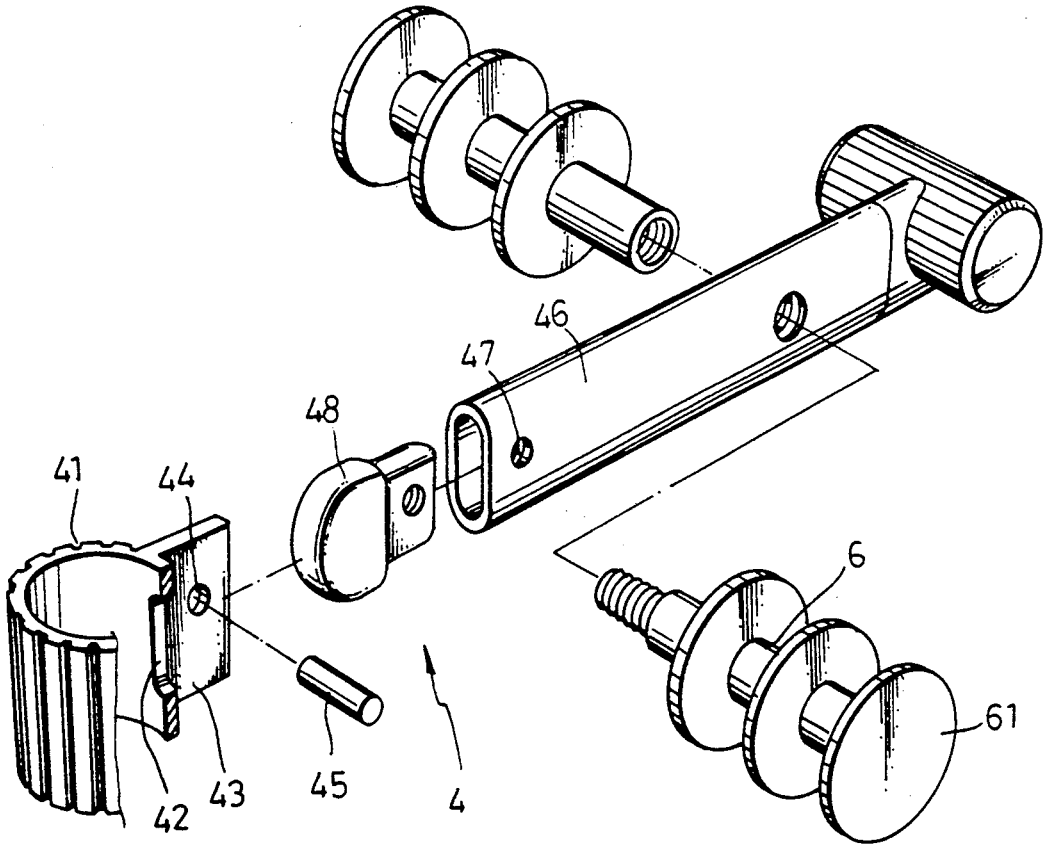
FIG. 3 an exploded view of the first branching hook and the branching rod.

Referring to FIG. 3, the first branching hook 4 is comprised of a peg rod 46 and a socket 41. The inner diameter of the socket 41 is slightly larger than the upright pole (namely, the tubes 2). The socket 41 of the first branching hook 4 has a longitudinal hole 42 on the peripheral wall thereof, and two side wings 43 longitudinally disposed by the longitudinal hole 42 at two opposite sides. The side wings 43 have each a small hole 44 aligned with each other. By inserting a lock pin 45 through holes 47 on the peg rod 46 and the small holes 44 on the side wings 43, the peg rod 46 is fastened to the socket 41. The peg rod 46 has a stop element 48 at one end inserted into the longitudinal hole 42 to stop against the upright pole. The opposite end of the peg rod 46 is fastened with two branching rods 6 at right angles, which two branching rods 6 are longitudinally alinged at two opposite sides, and have each a plurality of spaced radial flanges 61.

Figure 4:
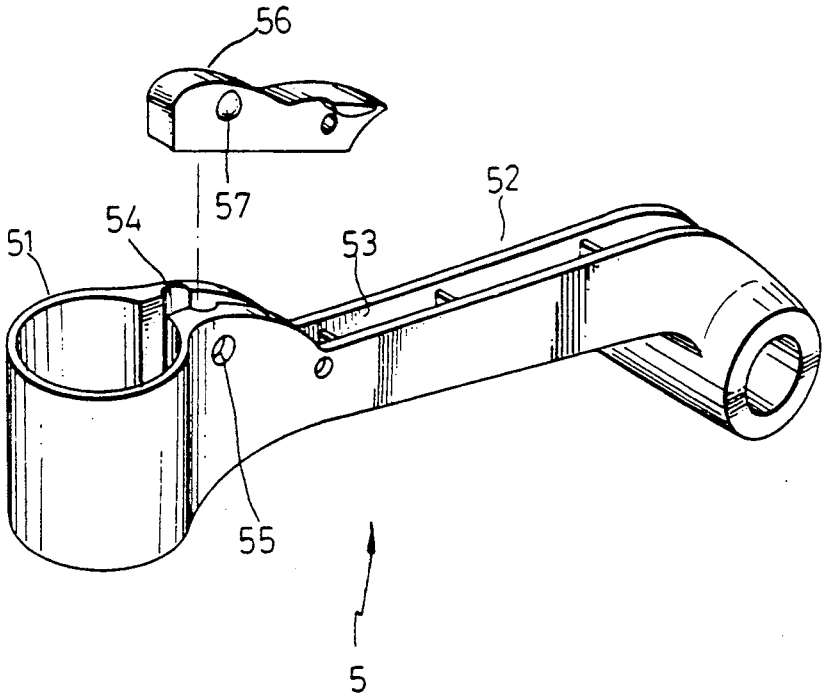
FIG. 4 is an exploded view of the second branching hook.

Referring to FIG. 4, the second branching hook 5 is comprised of a hanger rod 52 having one end formed into a socket 51, which has an inner diameter slightly larger than the upright pole (the tubes 2). The socket 51 has an opening 54 aligned with a longitudinal groove 53 on the hanger rod 52. The second branching hook 5 further comprises a tightening up element 56 fastened inside the longitudinal groove 53. The tightening up element 56 has two opposite front projections 57 respectively inserted into two opposite holes 55, which are formed on the two opposite side walls of the hanger rod 52 adjacent to the socket 51, and two opposite rear projections 57 respectively engaged into two opposite holes 55 on the inside of the longitudinal groove 53.

Figure 5:
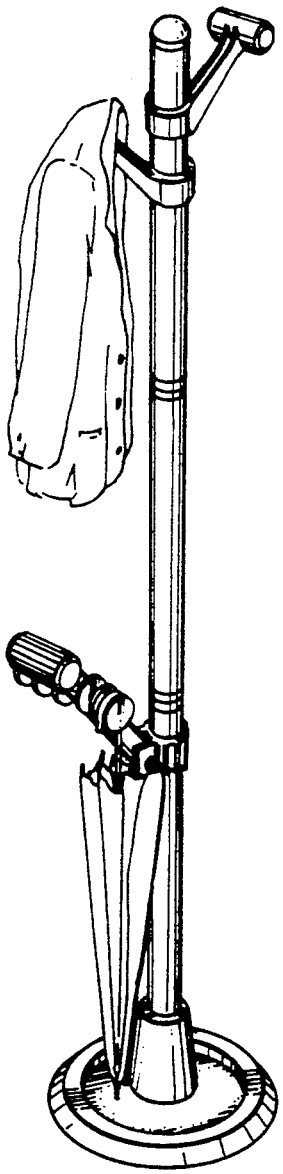
FIG. 5 is an elevational view of the preferred embodiment of the clothes tree of the present invention.

Referring to FIG. 5 and seeing FIGS. 1,2 again, insert the bushing 312 of the threaded tube 31 and the threaded bushing 32 into two tubes 2, and then, screw the threaded bushing 32 onto the screw rod 313 of the threaded tube 31 permitting two tubes 2 to be connected in line. By means of the aforesaid procedure, a plurality of tubes 2 are connected into an upright pole. The upright pole thus obtained is inserted in the hole 13 of the cone 11 of the stand 1. The socket 41 of each first branching hook 4 is sleeved onto either tube 2 of the upright pole and firmly retained in place by pressing the stop element 48 against the outside surface of the tube 2. The socket 51 of each second branching hook 5 is sleeved onto either tube 2 of the upright pole and firmly retained in place by a tightening up element 56. By setting the tightening up element 56 into "operative position" with the front end thereof tightly stopped against the outside surface of either tube 2 of the upright pole, the second branching hook 5 is firmly secured to the upright pole. By setting the tightening up element 56 into "non-operative position", with the front end thereof released from the outside surface of the upright pole, the second branching hook 5 can be moved up and down on the upright pole for position adjustment. When the branching rods 6 have been respectively connected to the first branching hooks 4, they are used to hand umbrellas.

What is claimed is:

1. A clothes tree comprising a stand, an upright pole comprising a pair of tubes connected in line by a connecting device and mounted on said stand, and a plurality of branching hooks fastened to said upright pole and used to hang clothes on, characterized in that: said stand comprises a cone upstanding therefrom and surrounded by a recessed groove, said cone having a hole at the center into which said upright pole is inserted; said branching hooks include at least one first branching hook, said at least one first branching hook comprising a peg rod having one end connected to a socket and terminating in a stop element, and an opposite end intersected with a branching rod, said socket being sleeved onto one tube of said upright pole and secured in place by said stop element, said socket comprising a longitudinal hole, into which said stop element is inserted to engage against said upright pole, two side wings longitudinally disposed adjacent said longitudinal hole on opposite sides thereof and formed with pin holes therein, into which a lock pin is inserted to connect said stop element and said peg rod to said socket, said branching rod having a plurality of spaced radial flanges.

2. The clothes tree of claim 1, wherein said branching hooks further comprise at least one second branching hook, said at least one second branching hook comprising a hanger rod used to hang clothes, and a tightening element used to secure said hanger rod to said upright pole, said hanger rod having one end formed into a socket sleeved onto a tube of said upright pole, the socket of said hanger rod comprising an opening aligned with a longitudinal groove on said hanger rod, said tightening element comprising two opposite front projections respectively pivotably inserted into two opposite holes on two opposite side walls of said hanger rod with a front end of said element releasably engaged against said upright pole, and two opposite rear projections respectively engaged into two opposite holes on the inside of said longitudinal groove.

3. The clothes tree of claim 1, wherein said connecting device comprises a threaded tube inserted in one tube of the pole, and a threaded bushing inserted in another tube of the pole, said threaded tube having one end formed into a bushing with raised outer strips and an opposite end formed into a screw rod, wherein the threaded tube comprises a partition wall between the bushing with raised outer strips and the screw, the bushing with raised outer strips being inserted in said one tube of the pole, said threaded bushing being symmetrically shaped relative to the bushing of said threaded tube, and being inserted in said another tube of the pole and being screwed onto said screw rod.

* * * * *